United States Patent [19]

Fusselman

[11] Patent Number: 4,973,258

[45] Date of Patent: Nov. 27, 1990

[54] GROUNDING CLIP OF THE INSULATION DISPLACEMENT TYPE

[75] Inventor: David F. Fusselman, Middletown, Pa.

[73] Assignee: E. I. Du Pont de Nemours and Company, Wilmington, Del.

[21] Appl. No.: 455,884

[22] Filed: Dec. 21, 1989

[51] Int. Cl.[5] ..... H01R 4/66

[52] U.S. Cl. ..... 439/98; 439/396

[58] Field of Search ..... 439/98, 396, 400, 580, 439/399, 578, 584, 610

[56] References Cited

U.S. PATENT DOCUMENTS

| | | | |
|---|---|---|---|
| 4,018,499 | 4/1977 | Rickards | 439/396 |
| 4,416,501 | 11/1983 | Fusselman et al. | 339/97 R |
| 4,641,902 | 2/1987 | Fusselman | 339/91 R |
| 4,701,001 | 10/1987 | Verhoeven | 439/394 |
| 4,749,365 | 6/1988 | Magnifico et al. | 439/396 |
| 4,749,366 | 6/1988 | McCaffery | 439/396 |

*Primary Examiner*—Eugene F. Desmond

[57] ABSTRACT

A grounding clip has a bridge portion with a first and a second tine extending therefrom. The tines are subdivided by a line of demarcation into first and second portions respectively defining the parts of the tine received in respective first and second housing sections. Each tine has a protrusion on each portion thereof. The protrusions are sized so that the protrusions snugly contact the housing section in which they are received in an interference fit.

16 Claims, 5 Drawing Sheets

GROUNDING CLIP OF THE INSULATION DISPLACEMENT TYPE

BACKGROUND OF THE INVENTION

1. Field of the Invention

The present invention relates to a grounding clip of the insulation displacement type.

2. Description of the Prior Art

A multiconductor shielded cable typically includes a plurality of individual conductors concentrically surrounded by a flexible conductive shield and an outer layer of insulation. The individual conductors may each comprise one or more strands of conducting wire(s) disposed within an insulating jacket. Although it may be implemented in various ways, the shield is usually formed as a sheath comprised of braided wire filaments.

It is common practice to interconnect electrically the metallic shield of the cable to the housing, or shroud, within which the cable is terminated. Exemplary of a device adapted to effect such an interconnection between the housing and the shield is the device shown in U.S. Pat. No. 4,416,501 (Fusselman et al.), and the device shown in U.S. Pat. No. 4,641,902 (Fusselman), both assigned to the assignee of the present invention. As perhaps best described in the first-referenced patent, the shielded cable grounding arrangement includes a tubular ferrule that is inserted beneath the shield of the cable. The grounding arrangement also includes a generally U-shaped insulation displacement clip that is itself received in slots formed in the housing. The bridge of the clip has a protrusion thereon. The protrusion is generally centrally disposed along the bridge of the clip. The exterior of the cable is introduced into the clip and, with the ferrule serving as a backing, the clip slices the insulating jacket of the cable to contact against the shield. Contact between the clip and the housing completes the grounding interconnection of the shield. U.S. Pat. No. 4,701,001 (Verhoeven) discloses a contact of the insulation displacement type having cutting edges thereon.

It is the typical practice to first insert the bridged end of the clip within the slot in one of the housing sections, the protrusion on the bridge serving to hold the clip in the slot in which it is placed. Thereafter the cable is placed in the gap between the tines of the clip. As the other housing section is mated with the first housing section the jacket of the cable is forced between the tines of the clip. This causes the jacket to be severed and establishes the electrical contact between the clip and the shield.

It has, however, been noted that in some instances the cable spreads the tines of the clip past their elastic limit as the upper housing section closes onto the lower housing section and forces the cable into the clip. Thus, when the housing sections are mated the tines do not spring back toward the cable. Instead, the jacket of the cable becomes compressed and the clip is not able to sever completely the insulating jacket of the cable. As a result the clip is not able to make electrical contact with the shield.

In addition, it has also been noted that the free ends of the tines of the clip are not at all times snugly received within the slot provided in the other housing section. As a result the grounding contact between the clip and the mated sections of the housing is not achieved to the same degree in each housing section. This condition usually manifests itself as a detectable difference in electrical characteristics of the cable.

In view of the foregoing it is believed advantageous to provide a grounding clip for interconnecting the metallic shield of a cable to the metallic housing of the cable connector or other termination in a fashion that effectively severs the insulating jacket of the cable and which uniformly connects the clip to both sections of the housing.

SUMMARY OF THE INVENTION

The present invention relates to a grounding arrangement for grounding a shield of a cable to a metallic housing and to a grounding clip of the insulation displacement type useful in the grounding arrangement. The housing is formed of conjoined first and second housing sections. The clip has a bridge portion with a first and a second tine extending therefrom. The clip has a first surface and a second surface thereon. With respect to the bridge portion, each tine has a first, proximal, beam region and a second, distal, beam region thereon. A transition region is defined between the proximal and distal beams of each tine. A first transverse distance is defined between the first beams and a second transverse distance is defined between the second beams, the second transverse distance being greater than the first transverse distance. A coined portion having a cutting edge thereon is defined in the transition region on each of the tines. The cutting edges are confrontationally disposed with respect to each other. Each tine has a line of demarcation thereon subdividing each tine into a first portion and a second portion. The first portion of each tine and the bridge thereof is receivable in a first housing section while the second portion of each tine is receivable in a second housing section.

Each tine has at least a first and a second protrusion formed thereon, the first protrusion being formed on the first portion of the tine while the second protrusion is formed on the second portion of the tine. The protrusions are sized so that when the bridge and the first portion of each tine are received in the first housing section and the second portion of each tine is received in a second housing section the protrusions on the respective first and second portions are in an interference fit with the respective first and second housing sections.

The distance from the line of demarcation to the tip of each tine being sized such that as the housing sections are conjoined the tip of each tine is within the second housing section before the second housing section forces the cable into the cutting edges. The ends of the tines are thus captured in the second housing and are not spread past their elastic limit as the cable is forced into the cutting edges. With the second transverse distance being sized greater than the outer diameter of the cable, as the cable is inserted into the clip the distal beam regions serve to center the cable between the tines and guide the jacket of the cable into the cutting edges. The edges slice the jacket of the cable as the housing sections are joined together. Moreover, since the first transverse distance is sized smaller than the outer diameter of the metallic shield when the housing sections are conjoined the shield electrically contacts the proximal beam regions of the clip.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
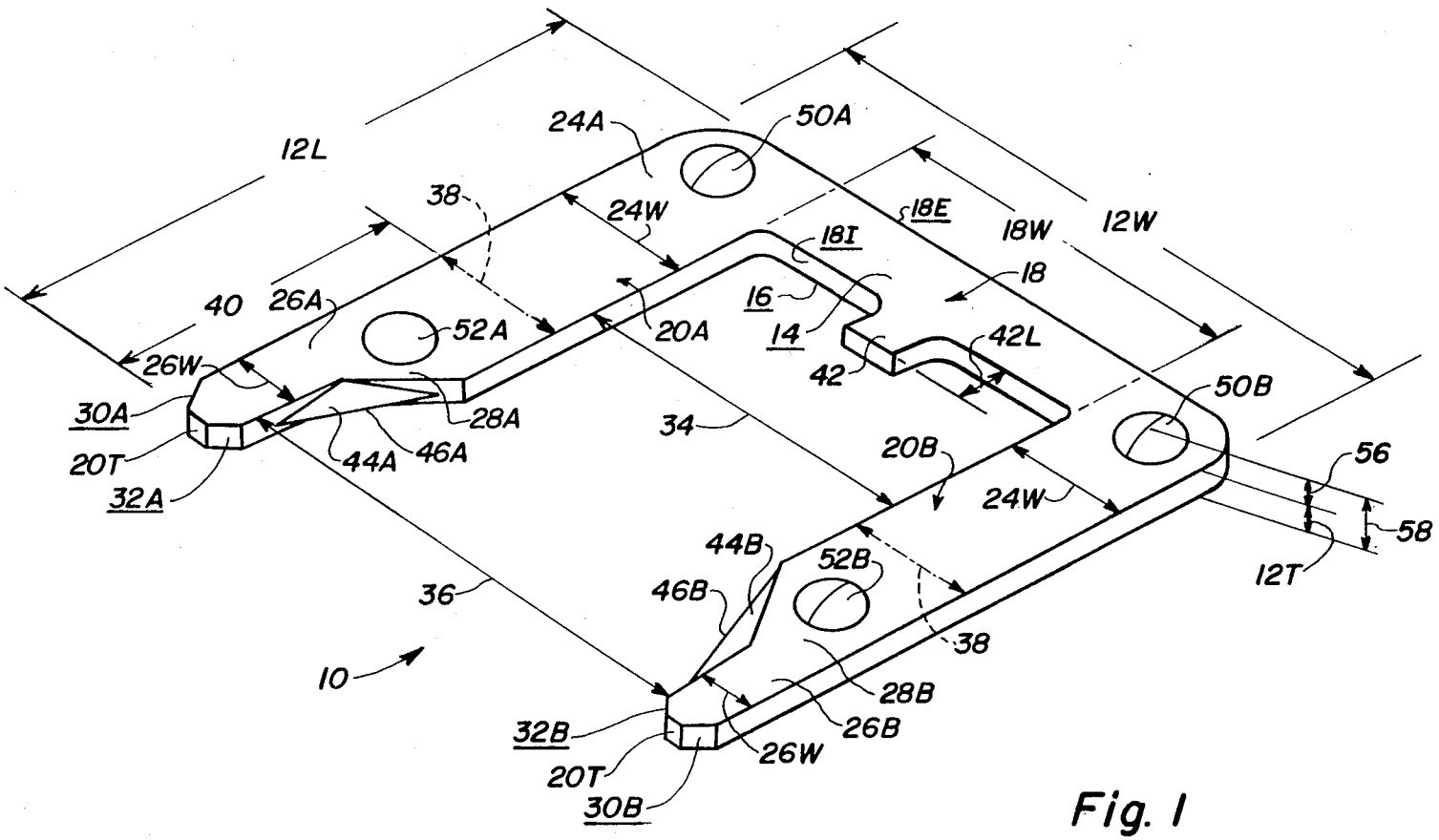
FIG. 1 is a perspective view of an insulation displacement clip in accordance with the present invention.

Throughout the following detailed description similar reference numerals refer to similar elements in all figures of the drawings.

FIG. 1 illustrates a perspective view of a clip 10 of the insulation displacement type in accordance with the present invention. The clip 10 is integrally formed, as by stamping, from any suitable conductive material, such as brass, beryllium/copper or phosphorus/bronze. The clip 10 has a predetermined basic thickness dimension 12T, a predetermined width dimension 12W and a predetermined overall length dimension 12L associated therewith. The clip 10 has a first, generally planar, surface 14 and a second, opposed, generally planar surface 16. The clip 10 is a generally U-shaped member that includes a bridge portion 18. The bridge has a width dimension 18W associated therewith. A first tine 20A and a second tine 20B extend from the bridge portion 18. Measured from the outside surface 18E of the bridge 18 to the tip 20T thereof, each tine has a predetermined length dimension that is equal to the overall length 12L of the clip 10. As is made clearer herein the predetermined width dimension 12W of the clip 10 is, at its maximum, slightly less than the maximum width dimension $W_1$, $W_2$ of the receptacle $R_1$, $R_2$ of the housing section $H_1$, $H_2$, as the case may be, in which the clip 10 is disposed (see width dimension $W_1$ in FIG. 2).

Each tine 20A, 20B has a first, enlarged beam region 24A, 24B, respectively, disposed proximally with respect to the bridge 18. Distally located on each tine with respect to the bridge 18 is a second, reduced width guidance beam region 26A, 26B, respectively. The transverse width dimension 24W of each of the enlarged beam regions 24A, 24B is greater than the transverse width dimension 26W of each of the guidance beam regions 26A, 26B. Accordingly, a tapered transition region 28A, 28B is defined on each respective tine 20A, 20B between the enlarged beam region 24A, 24B and the guidance beam region 26A, 26B. The tips 20T of the respective tines 20A, 20B have exterior lead-in surfaces 30A, 30B and interior lead-in surfaces 32A, 32B, respectively.

The enlarged beam regions 24A, 24B are spaced apart by a first predetermined transverse span distance that defines an insulation displacement gap 34. Preferably, the dimension of the insulation displacement gap 34 is substantially equal to the outer diameter "d" of a ferrule F (seen, for example, in FIG. 2) used in connection with the clip 10 so that, as will be described, at least one point along each of the enlarged beam regions 24A, 24B of the respective tines 20A, 20B of the clip 10 lies in an interference fit with the shield S of the cable C with which the clip is to be used (FIG. 4D). The respective guidance beam regions 26A, 26B on the tines 20A, 20B are spaced by a second predetermined transverse span distance that defines a cable locating gap 36. The dimension of the cable locating gap 36 is greater than the dimension of the insulation displacement gap 34. As will be developed, the dimension of the cable locating gap 36 is larger than the outer diameter D (FIG. 2) of a cable C with which the clip 10 is to be used.

An imaginary line of demarcation 38 is defined on each tine 20A, 20B. In FIG. 1 the line of demarcation is shown as being located on the enlarged beam region 24A, 24B. The tip 20T of each respective tine 20A, 20B is spaced a predetermined distance 40 from the line of demarcation 38. As will be discussed the location of the line of demarcation 38 along the tines is determined by the location on the tines at which the mating surfaces of housing sections $H_1$, $H_2$ defining a housing are joined together. It should be understood that depending upon the relative lengths of the beam portions 24, 26 and 28, and the location of the mating surfaces between the housing sections with respect to the lengths of these portions, the line of demarcation may alternately be located on the region 26A, 26B or on the region 28A, 28B.

A spur 42 extends from the inside surface 18I of the bridge portion 18 into the insulation displacement gap 34. The dimension 42L of the spur 42, as measured from the surface 18I, is equal to the thickness of a jacket J on the cable.

A coined cutting member 44A, 44B is respectively provided on each tine 20A, 20B in the vicinity of the transition region 28A, 28B, respectively. The members 44A, 44B each have a respective cutting edge 46A, 46B thereon that confronts each other across the cable locating gap 36. The cutting edges 46A, 46B are tapered, the widest gap therebetween being substantially equal to the cable locating gap 36 while the narrowest gap therebetween is substantially equal to the insulation displacement gap 34. One end of each cutting edge is adjacent to the proximal beam region of the tine on which the cutting edge is disposed while the second end of each cutting edge is adjacent to the distal beam region of the tine on which the cutting edge is disposed.

In the preferred instance, a pair of protrusions, or dimples, 50A, 52A and 50B, 52B are respectively provided on each of the tines 20A, 20B. The dimples are conveniently formed at the time the clip 10 is stamped. The protrusions 50A, 52A on the tine 20A are located on each side of the line of demarcation 38 on that tine 20A. Similarly, the protrusions 50B, 52B on the tine 20B are located on each side of the line of demarcation 38 on that tine 20B. This disposition of the protrusions on the tines insures that, when the grounding arrangement of which the clip 10 forms a part is assembled, one of the protrusions on each tine contacts one of the housing sections. In FIG. 1 the dimples 50A, 52A are located on the first tine 20A respectively adjacent to the bridge portion 18 and adjacent to the transition region 28A thereon while the dimples 50B, 52B are similarly disposed on the second tine 20B. Although FIG. 1 illustrates two dimples on each tine, it should be understood that any convenient number of dimples may be provided on each tine, so long as at least one dimple is located on each side of the line of demarcation 38.

In FIG. 1 all of the dimples 50A, 50B, 52A, 52B are provided on the first surface 14 of the clip 10. It should be understood that some of these protrusions 50A, 50B, 52A, 52B could be alternately located on the opposite surface 16 of the clip. If additional protrusions are provided some or all of these additional protrusions could be located on the opposite surface 16.

As is also seen in FIG. 1 each dimple 50A, 50B, 52A, 52B extends a predetermined distance 56 above the first surface 14 of the clip 10 on which they are provided. The distance 56 that each dimple extends above the surface 14 is substantially uniform. As will be discussed herein the sum of the basic thickness dimension 12T of the clip 10 and the predetermined distance 56 that the dimples each extend above the surface 14 on which they are formed defines an effective overall thickness dimension 58 of the clip 12. The effective overall thickness dimension 58 of the clip 12 is, at its minimum, greater than the maximum thickness dimension $T_1$, $T_2$ (FIG. 3) of the receptacle $R_1$, $R_2$in the housing section $H_1$, $H_2$, as the case may be, in which the clip 10 is disposed. If protrusions are provided on the opposite surface, the determination of the effective overall thickness dimension 58 of the clip 12 would, of course, take the location of these additional protrusions into account. However, in any event, the effective overall thickness dimension of such a clip 12 would meet the constraint that its effective overall thickness dimension would be, at its minimum, greater than the maximum thickness dimension of the receptacle in the housing section in which such a clip is disposed.

The clip 10 in accordance with the present invention is especially adapted for use in a grounding arrangement for interconnecting a shield S of a cable C to a housing H. A multiconductor shielded cable C such as that illustrated in FIGS. 2 and 3 typically includes a plurality of individual conductors I. The individual conductors I may be collectively concentrically surrounded by a flexible conductive shield S and an outer insulating jacket J. The jacket J of the cable C has an outer surface thereon and a predetermined outer diameter D. The individual conductors I may each comprise one or more strands of conducting wire(s) disposed within an insulating jacket. The flexible conductive shield S generally takes the form of a sheath comprised of braided metallic wire filaments. The shield S, when connected to ground potential, collectively isolates the conductors I carried within the cable C.

Figure 2:
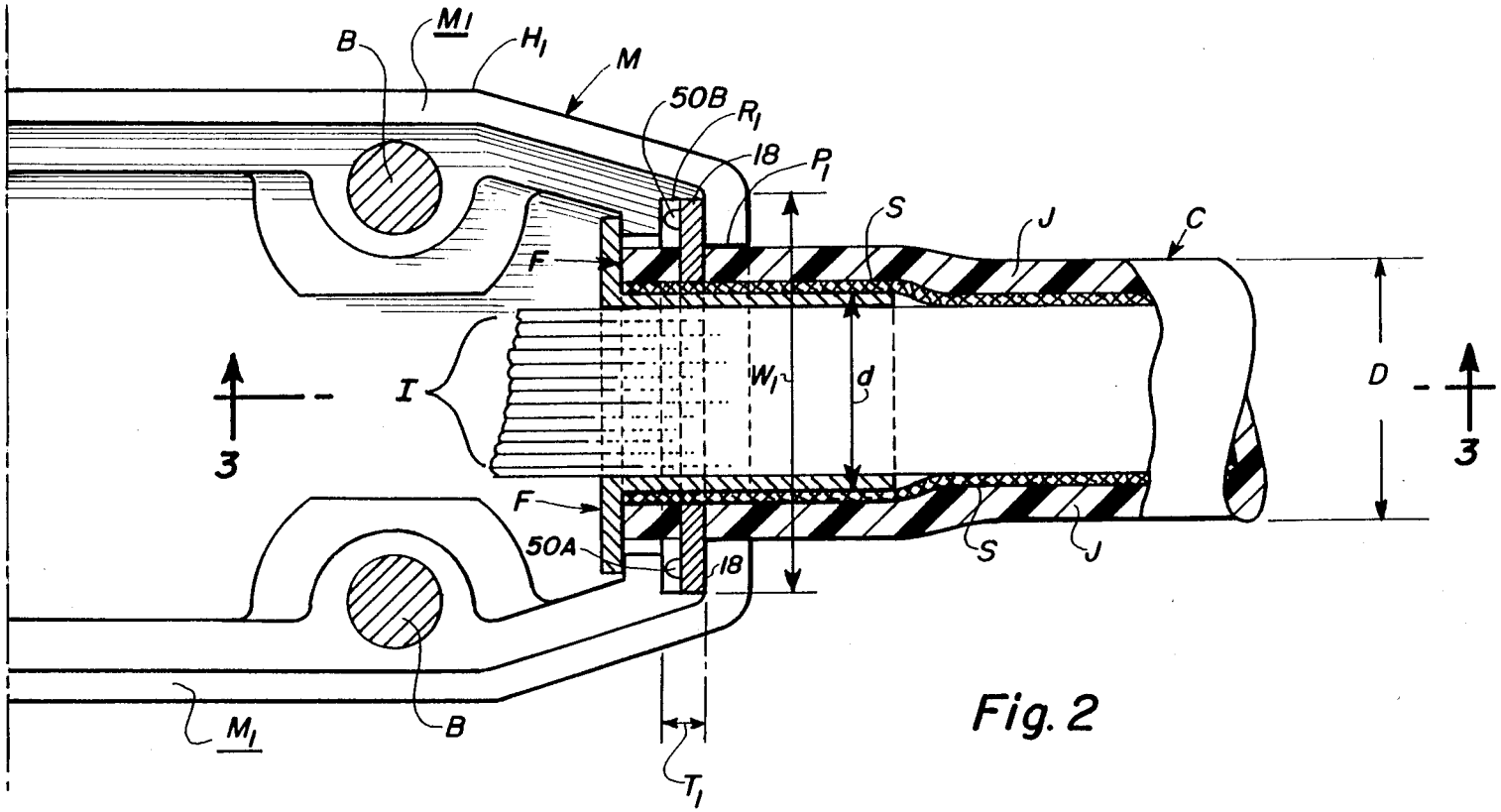
FIG. 2 is a side elevational view entirely in section of a clip as shown in FIG. 1 received within a housing formed of mated first and second housing sections illustrating the receipt of the clip in the slots provided in the housing sections, the section being taken in a plane parallel to the plane of the mating surfaces of the conjoined housing sections.
Figure 3:
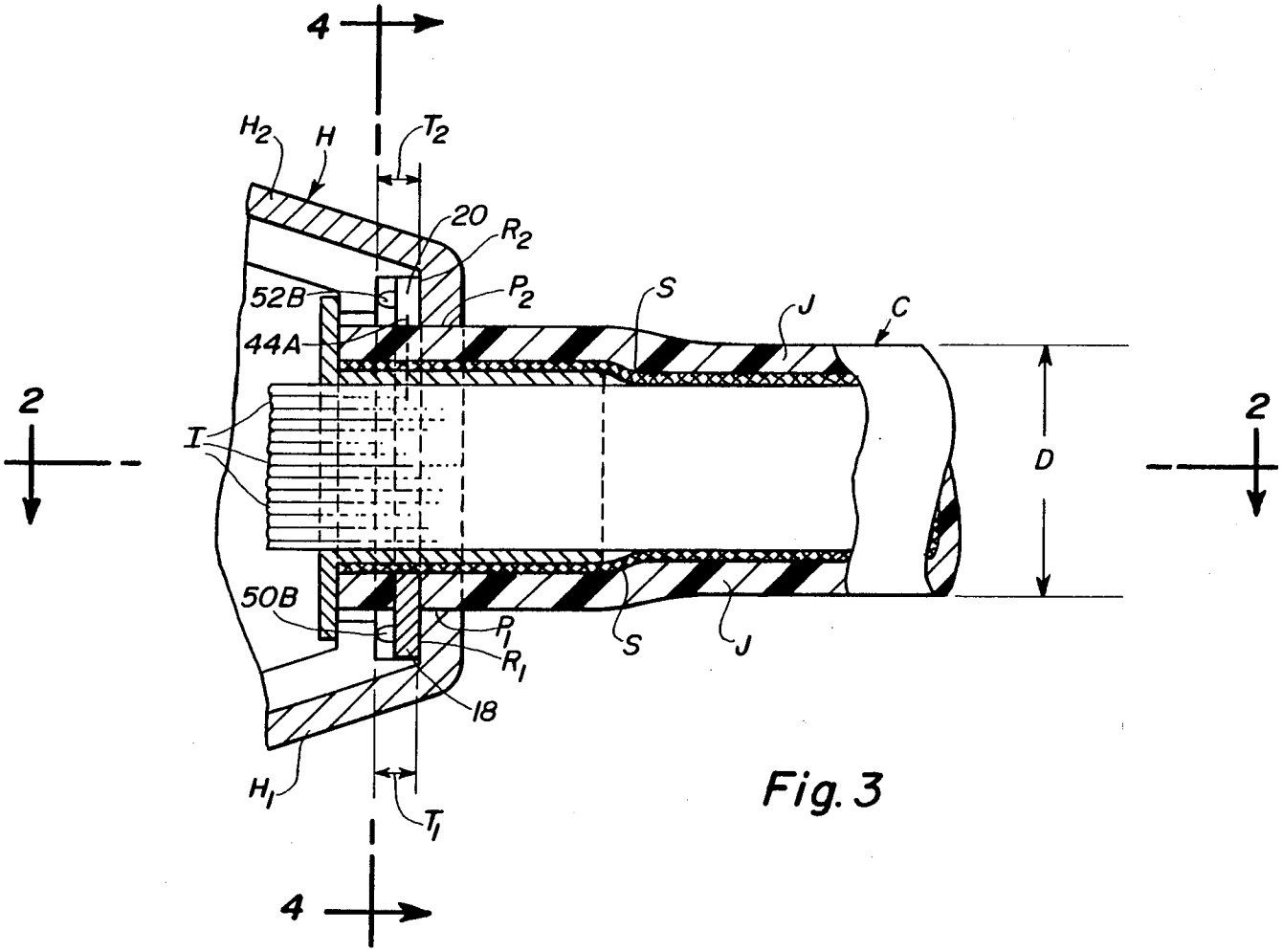
FIG. 3 is a view, entirely in section, taken along section lines 3—3 in FIG. 2, illustrating the receipt of the clip in the slots provided in the housing sections, the section of FIG. 3 being taken in a plane perpendicular to the plane of the mating surfaces of the conjoined housing sections.

The cable C is typically terminated in a housing H formed of two conjoined housing sections $H_1$, $H_2$ (FIGS. 3 and 4D). Each housing section is formed of a conductive material or lined with a layer of a conductive material. The housing sections $H_1$, $H_2$ are matable along confronting mating surfaces $M_1$, $M_2$. FIG. 2 is a sectional view in a plane parallel to the mating plane $M_1$ of one of the housing sections $H_1$, while FIG. 3 is a sectional view taken in a plane perpendicular thereto. Bolts B (FIG. 2) or any other suitable expedient may be used to hold together the housing sections $H_1$, $H_2$. Each housing section $H_1$, $H_2$ has a receptacle $R_1$, $R_2$ in the form of a circumferential slot that lies adjacent to an access openings $P_1$, $P_2$ (FIG. 4A) respectively defined in each of the housing sections $H_1$, $H_2$. When the sections $H_1$, $H_2$ are mated the openings $P_1$, $P_2$ define an access passage P (FIG. 4D) for the cable C. Each receptacle $R_1$, $R_2$ has a thickness dimension $T_1$, $T_2$ (FIG. 3) that is less than the overall thickness dimension 58 of the clip 10 and a width dimension $W_1$, $W_2$ (FIG. 4A) that is slightly greater than the width dimension 12W of the clip 10.

The termination and grounding of the shield of the cable C is set forth in U.S. Pat. No. 4,416,501, which is hereby incorporated by reference herein. As noted in that patent the cable C is prepared by removing the outer insulating jacket J and the shield S from a portion of the cable to leave an exposed end of the cable C. A ferrule F, in the shape of a metallic sleeve having an outwardly projecting collar, is inserted beneath the shield S of the cable C. The ferrule F is usually formed a conductive material and has a predetermined outer diameter dimension "d". The ferrule F is inserted under the shield S and is in electrical contact therewith.

Figure 4B:
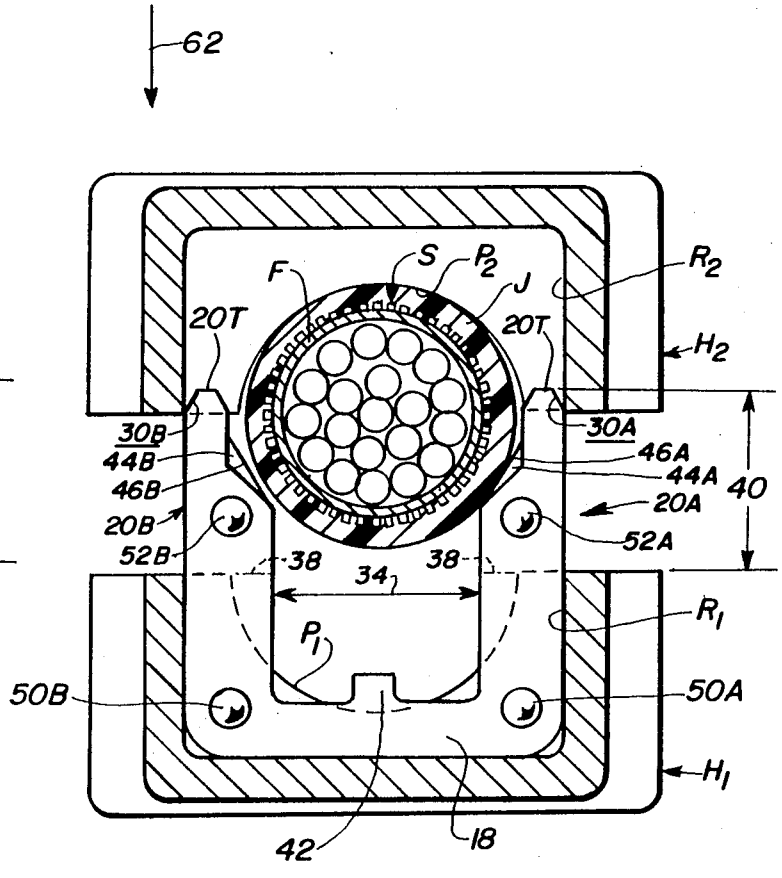
FIGS. 4A through 4D are sectional views, taken along section lines 4—4 in FIG. 3, that illustrate the disposition of the various portions of the clip in accordance with the present invention as the housing sections of a termination housing is sequentially mated to cause the clip to electrically interconnect with the shield of the cable.
Figure 4A:
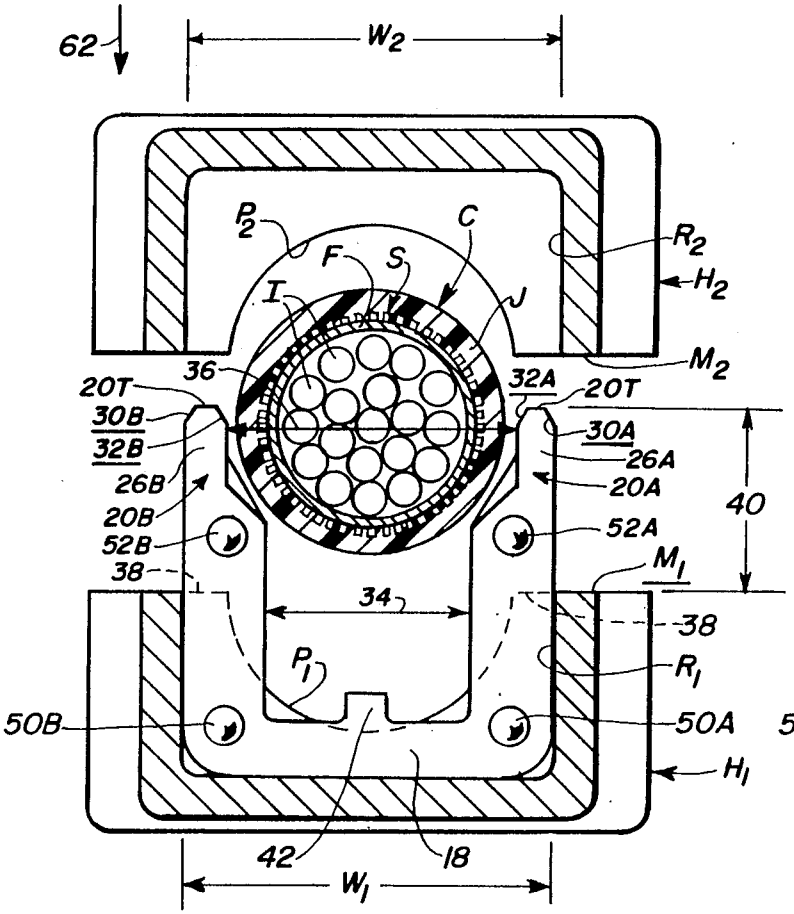
Figure 4D:
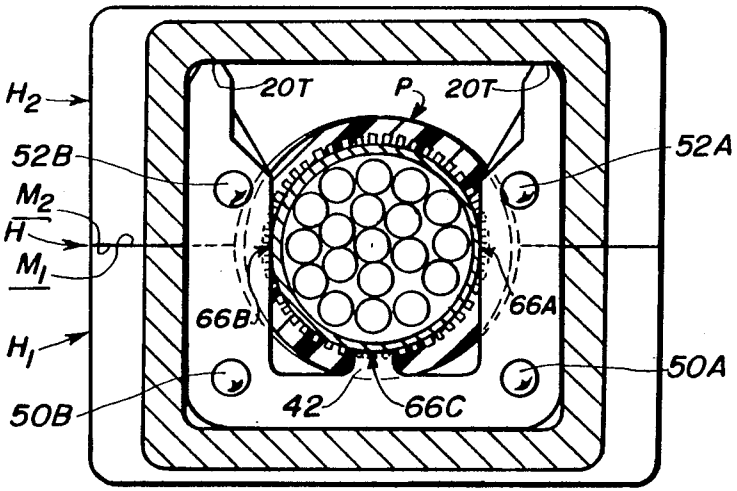

The use of a clip 10 in accordance with the present invention to form a grounding interconnection with the shield S of the cable C may be understood from FIGS. 4A through 4D. These Figures are vertical sectional views taken along view line 4—4 in FIG. 3. The clip 10 is inserted into the receptacle $R_1$ in one of the housing sections, for example, the housing section $H_1$. Because the overall thickness dimension 58 of the clip 10 is greater than the thickness dimensions $T_1$, $T_2$ of the receptacles $R_1$, $R_2$ when the clip 10 is received in the receptacles it is received with an interference fit, and is thus maintained in uniform electrical contact with both of the housing sections $H_1$, $H_2$. The clip 10 is inserted into the housing section $H_1$ with the bridge 18 received in the receptacle $R_1$ and the tines 20A, 20B projecting upwardly therefrom. The line of demarcation 38 aligns with the mating surface $M_1$ and the tines 20A, 20B extend above the mating surface $M_1$ for the distance 40. With the clip 10 so disposed, the cable C is laid into the cable locating gap 36 between the guidance beam regions 26A, 26B (FIG. 4A).

The other housing section $H_2$ is lowered onto the housing section $H_1$ in a direction 62 that is perpendicular to the axis of the cable C. As may be appreciated from FIG. 4B the distance 40 of the clip 10 is selected such that the tips 20T of the tines 20A, 20B extend into the receptacle $R_2$ in the housing section $H_2$ before the portion of the housing section $H_2$ that defines the passage $P_2$ can exert a downward force on the cable C. Thus the tips 20T of the tines are within the housing section $H_2$ before the cable C is force into the cutting edges 46A, 46B in the respective transitions 28A, 28B. The exterior lead-in portions 30A, 30B on the tines 20A, 20B guide the tines into the receptacle $R_2$ in the housing section $H_2$.

Figure 4C:
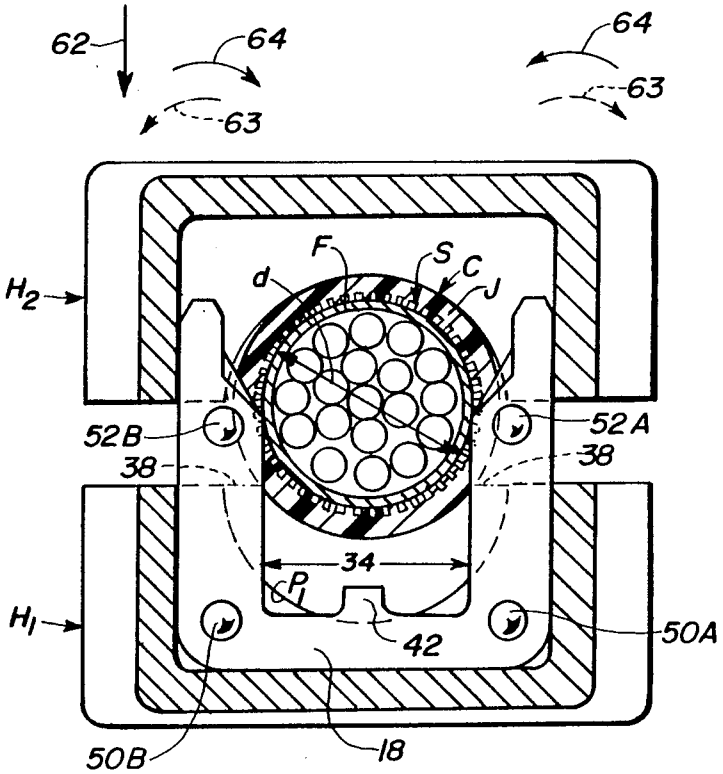

With reference to FIG. 4C, continued closing movement of the housing section $H_2$ in the direction 62 forces the cable C into contact with the cutting edges 46A, 46B, respectively on the cutting members 44A, 44B. This action severs the jacket J of the cable C. Since the dimension of the insulation displacement gap 34 is equal to the outer diameter of the ferrule F, as the cable C is forced into the clip 10, an interference fit is formed between the tines 20A, 20B and the shield S of the cable C.

Since the part of the tines 20A, 20B in the vicinity of the tips 20T are already within the housing section $H_2$ when the cable C is forced into the cutting edges 46A, 46B the tines are held captive by the housing section $H_2$ and the insulation displacement gap is maintained at its original dimension and are prevented from being spread apart past their elastic limit by the cable C. That is, the tines cannot move in the direction of the arrows 63. The cutting edges 46A, 46B can, therefore, effectively slice through the insulating jacket J of the cable C and no compression of the jacket J can occur. It should be understood that some slight deflection of the tines in the direction of the arrow 63 may be tolerated, as long as the tines are not spread past their elastic limit. Further, the tines generate a restoring force in the direction of the arrows 64 which holds the tines against the shield S of the cable after the cut is made.

Finally, as may be seen in FIG. 4D, as the mating surfaces $M_1$, $M_2$ on the housing sections $H_1$, $H_2$ are brought together, the spur 42 on the bridge portion 18 of the clip 10 punctures the jacket J of the cable C. When the housing sections $H_1$, $H_2$ are mated, there is defined at least three-point contact between the clip 10 and the shield S. Specifically, one tine 20A contacts the shield S at a first contact point 66A, the other tine 20B contacts the shield S at a second contact point 66B, while the spur 42 contacts the shield S at the third contact point 66C. When mated, the passages $P_1$, $P_2$ register to define the opening P through which the cable C extends. Note also that the tips 20T of the tines 20A, 20B may contact the housing $H_2$.

It should be appreciated that a clip 10 in accordance with the present invention overcomes all of the perceived disadvantages of the prior art. Since there is a protrusion provided on the portion of each tine received in each housing section, and since the overall thickness dimension 58 of the clip 10 exceeds the thickness dimension $T_1$, $T_2$ of the receptacles $R_1$, $R_2$, the clip 10 is snugly received in the housing, thus providing intimate electrical contact therewith. Further, since the tines are permitted to deflect only a slight extent, the cutting edges 46A, 46B on the coined members 44A, 44B effectively sever the jacket J of the cable C.

Those skilled in the art, having the benefit of the teachings of the present invention, may impart numerous modifications thereto. Such modifications are, however, to be construed as lying within the contemplation of the present invention, as defined by the appended claims.

What is claimed is:

1. A grounding clip of the insulation displacement type for receipt in a housing formed of conjoined first and second housing sections, the clip having a bridge with a first and a second tine extending therefrom, the clip having a first surface and a second surface thereon, each tine having a proximal beam region and a distal beam region thereon with a transition region defined between the proximal and distal beam regions, the proximal beam region on each of the tines being spaced apart a first transverse distance to define an insulation displacement gap while the distal beam region on each of the the tines is spaced apart a second transverse distance, the second transverse distance being greater than the first transverse distance, a coined cutting edge defined in the transition region on each of the tines, the cutting edges being confrontationally disposed, each cutting edge having a first end and a second end thereon, the first end of each cutting edge being adjacent to the proximal beam region of the tine on which the cutting edge is disposed while the second end of each cutting edge is adjacent to the distal beam region of the tine on which the cutting edge is disposed, each tine having a line of demarcation thereon, the line of demarcation subdividing each tine into a first portion and a second portion, the first portion of each tine and the bridge thereof being receivable in a first housing section while the second portion of each tine is receivable in a second housing section, each tine having at least a first and a second protrusion formed thereon, the first protrusion being formed on the first portion of the tine while the second protrusion is formed on the second portion of the tine, the protrusions being sized so that when the bridge and the first portion of each tine are received in a first housing section and the second portion of each tine is received in a second housing section the protrusions on the respective first and second portions are in an interference fit with the respective first and second housing sections.

2. The grounding clip of claim 1 wherein the housing sections each have an opening therein that cooperate when the housing sections are conjoined to define an aperture through which a cable enters into the conjoined housing sections, the cable having a jacket with predetermined outer diameter and an outer surface thereon, the cable having a metallic shield having a predetermined outer diameter thereon, wherein each tine has a tip thereon, the tip being disposed at the end of the distal beam region of the tine, the distance from the line of demarcation to the tip of each tine being sized such that as the housing sections are conjoined the tip of each tine is within the second housing section before the second housing section forces the cable into the cutting edges on the transition regions;

the second transverse distance being sized greater than the outer diameter of the cable, the distal beam regions serving to center the cable between the tines and guide the jacket of the cable into the cutting edges so that the cutting edges slice the jacket of the cable as the housing sections are joined together, the first transverse distance being sized smaller than the outer diameter of the metallic shield so that when the housing sections are conjoined the shield electrically contacts the proximal beam regions of the clip.

3. The grounding clip of claim 2 wherein the line of demarcation lies on the proximal region of each tine.

4. The grounding clip of claim 1 wherein the line of demarcation lies on the proximal region of each tine.

5. The grounding clip of claim 2 wherein all of the protrusions are located on the first surface of the clip.

6. The grounding clip of claim 1 wherein all of the protrusions thereon are located on the first surface of the clip.

7. The grounding clip of claim 2 wherein the cable has a jacket having a predetermined thickness dimension, and wherein the clip further comprises a spur formed on the bridge, the spur extending into the insulation displacement gap a predetermined distance substantially equal to the thickness dimension of the jacket of the cable.

8. The grounding clip of claim 1 wherein the housing sections each have an opening therein that cooperate when the housing sections are conjoined to define an aperture through which a cable enters into the conjoined housing sections, the cable has a jacket having a predetermined thickness dimension, and wherein the clip further comprises a spur formed on the bridge, the spur extending into the insulation displacement gap a predetermined distance substantially equal to the thickness dimension of the jacket of the cable.

9. A grounding arrangement for grounding a shielded cable having a jacket thereon and a metallic shield under the jacket, the grounding system being of the type having a metallic ferrule insertable under the metallic shield, a first conductive housing section and a second conductive housing section, each housing section having a slot therein, and a clip of the insulation displacement type, the clip having a bridge portion with a first and a second tine extending therefrom, the clip having a first surface and a second surface thereon, wherein the improvement comprises:

each tine has a proximal beam region and a distal beam region thereon with a transition region defined between the proximal and distal beam regions, the proximal beam region on each of the tines being spaced a first transverse distance to define an insulation displacement gap while the distal beam region on each of the tines is spaced a second transverse distance, the second transverse distance being greater than the first transverse distance, a coined cutting edge defined in the transition region on each of the tines, the cutting edges being confrontationally disposed, each cutting edge having a first end and a second end thereon, the first end of each cutting edge being adjacent to the proximal beam region of the tine on which the cutting edge is disposed while the second end of each cutting edge is adjacent to the distal beam region of the tine on which the cutting edge is disposed, each tine having a line of demarcation thereon, the line of demarcation subdividing each tine into a first portion and a second portion, the first portion of each tine and the bridge thereof being receivable in a first housing section while the second portion of each tine is receivable in a second housing section, each tine having at least a first and a second protrusion formed thereon, the first protrusion being formed on the first portion of the tine while the second protrusion on each tine is formed on the second portion thereof, the protrusions being sized so that when the bridge and the first portion of each tine is received in the slot in the first housing section and the second portion of each tine is received in the slot in the second housing section the protrusions on the respective first and second portions are received in an interference fit with the respective first and second housing sections.

10. The grounding arrangement of claim 9 wherein the housing sections each have an opening therein that cooperate when the housing sections are conjoined to define an aperture through which a cable enters into the conjoined housing sections, the cable having a jacket with predetermined outer diameter and an outer surface thereon, the cable having a metallic shield having a predetermined outer diameter thereon, and wherein each tine has a tip thereon, the tip being disposed at the end of the distal region of the tine, the distance from the line of demarcation to the tip of each tine being sized such that as the housing sections are joined the tip of each tine is within the second housing section before the second housing section forces the cable into the cutting edges on the transition regions;

the second transverse distance being sized greater than the outer diameter of the cable, the distal beam regions serving to center the cable between the tines and guide the jacket of the cable into the cutting edges so that the cutting edges slice the jacket of the cable as the housing sections are joined together, the first transverse distance being sized smaller than the outer diameter of the metallic shield so that when the housing sections are joined together the shield electrically contacts the proximal beam regions of the clip.

11. The grounding arrangement of claim 10 wherein the line of demarcation lies on the proximal region of each tine.

12. The grounding arrangement of claim 9 wherein the line of demarcation lies on the proximal region of each tine.

13. The grounding arrangement of claim 10 wherein all of the protrusions are located on the first surface of the clip.

14. The grounding arrangement of claim 9 wherein all of the protrusions thereon are located on the first surface of the clip.

15. The grounding arrangement of claim 10 wherein the cable has a jacket having a predetermined thickness dimension, and wherein the clip further comprises a spur formed on the bridge, the spur extending into the insulation displacement gap a predetermined distance substantially equal to the thickness dimension of the jacket of the cable.

16. The grounding arrangement of claim 9 wherein the housing sections each have an opening therein that cooperate when the housing sections are conjoined to define an aperture through which a cable enters into the conjoined housing sections, the cable has a jacket having a predetermined thickness dimension, and wherein the clip further comprises a spur formed on the bridge, the spur extending into the insulation displacement gap a predetermined distance substantially equal to the thickness dimension of the jacket of the cable.

* * * * *